US011603707B2

(12) United States Patent
Carver

(10) Patent No.: US 11,603,707 B2
(45) Date of Patent: Mar. 14, 2023

(54) CARRIER, AND RELATED SYSTEMS AND METHODS

(71) Applicant: Christopher Carver, Enumclaw, WA (US)

(72) Inventor: Christopher Carver, Enumclaw, WA (US)

( * ) Notice: Subject to any disclaimer, the term of this patent is extended or adjusted under 35 U.S.C. 154(b) by 0 days.

(21) Appl. No.: 16/434,702

(22) Filed: Jun. 7, 2019

(65) Prior Publication Data

US 2019/0383101 A1 Dec. 19, 2019

Related U.S. Application Data

(60) Provisional application No. 62/685,112, filed on Jun. 14, 2018.

(51) Int. Cl.

| | |
|---|---|
| ***E06C 7/16*** | (2006.01) |
| ***A45F 3/14*** | (2006.01) |
| ***E06C 7/18*** | (2006.01) |

(52) U.S. Cl.

CPC ..... *E06C 7/165* (2013.01); *A45F 3/14* (2013.01); *E06C 7/188* (2013.01)

(58) Field of Classification Search

CPC ..... E06C 7/165; E06C 7/16; E06C 7/188
See application file for complete search history.

(56) References Cited

U.S. PATENT DOCUMENTS

| | | | | |
|---|---|---|---|---|
| 1,452,182 | A * | 4/1923 | Butrum | E06C 7/16 182/121 |
| 2,680,554 | A * | 6/1954 | Dakin | E06C 7/16 182/214 |
| 4,730,697 | A * | 3/1988 | Campbell | E06C 7/16 182/121 |
| 5,429,205 | A * | 7/1995 | Collins | E06C 7/14 182/122 |
| 6,527,084 | B2 * | 3/2003 | Hrincu | E06C 7/44 182/180.2 |
| 6,761,246 | B2 * | 7/2004 | Bowles | E04G 1/30 182/117 |
| 8,631,904 | B1 * | 1/2014 | Wilds | E06C 7/16 182/116 |
| 10,006,248 | B2 * | 6/2018 | Goodnow | E06C 7/08 |

(Continued)

*Primary Examiner* — Scott T McNurlen
(74) *Attorney, Agent, or Firm* — Janeway Patent Law PLLC; John M. Janeway

(57) ABSTRACT

A carrier comprises a frame coupleable with a ladder in a first position and a second position, and a harness that one can wear to hold the frame to himself/herself. In the first position, the frame supports the ladder when one carries the frame. In the second position, the frame and ladder, together, support one when one sits on the frame. The carrier's frame includes a first member that holds the ladder when the frame is in the first position, and a second member that supports a person sitting on the frame when the frame is in the second position. With the ability to position the carrier's frame in a first position and a second position, one can use the carrier to carry a ladder to and from where one will be working without having to use one or both of one's hands. This allows one to use both hands and/or arms to carry one's tools and supplies to where one will be working. Then, later in the day, one can use the same carrier to sit on while taking a break.

14 Claims, 4 Drawing Sheets

(56) References Cited

U.S. PATENT DOCUMENTS

| | | | | |
|---|---|---|---|---|
| 2007/0084893 | A1* | 4/2007 | Godshaw | A45F 3/14<br>224/257 |
| 2007/0228098 | A1* | 10/2007 | Teeters | A45F 3/10<br>224/633 |

* cited by examiner

CARRIER, AND RELATED SYSTEMS AND METHODS

BACKGROUND

Constructing a new home or commercial building, or remodeling a home or commercial building often includes work performed by an electrician. Examples of such work include laying out a new circuit by running wires through an unfinished wall or ceiling, and installing receptacles, lights and other devices that allow the home owner or worker to access and use electricity. Because such work often requires an electrician to run wires or install devices a couple of feet or more above his head, electricians frequently have a step ladder that they carry to and use at a job site. Depending on the work involved, the step ladder may be a four-foot ladder, a six-foot ladder or even an eight-foot ladder.

Unfortunately, many job sites are large and require an electrician to carry his ladder a substantial distance and often up one or flights of stairs along with all of his tools and supplies. Because of this, many electricians make multiple trips between their vehicle and where they will be working for a while. Such trips reduce the amount of time that the electrician spends working on the job, and thus increases the time it takes to complete the job. In addition, when an electrician works on new construction, he/she often walks back to their vehicle for a break or lunch because there typically isn't any place to sit where they are working. This, too reduces the amount of time that the electrician spends working on the job, and thus increases the time it takes to complete the job.

Thus, there is a need for a carrier that an electrician can use to carry his/her ladder to and from where they are working, and that they can use to sit on when they need a break.

SUMMARY

In one aspect of the invention, a carrier comprises a frame coupleable with a ladder in a first position and a second position, and a harness that one can wear to hold the frame to himself/herself. In the first position, the frame supports the ladder when one carries the frame. In the second position, the frame and ladder, together, support one when one sits on the frame. The carrier's frame includes a first member that holds the ladder when the frame is in the first position, and a second member that supports a person sitting on the frame when the frame is in the second position.

With the ability to position the carrier's frame in a first position and a second position, one can use the carrier to carry a ladder to and from where one will be working without having to use one or both of one's hands. This allows one to use both hands and/or arms to carry one's tools and supplies to where one will be working. Then, later in the day, one can use the same carrier to sit on while taking a break.

In another aspect of the invention, a method for carrying a ladder comprises: a) coupling a first member of a frame of a carrier with a ladder, wherein the frame is coupleable in a first position and in a second position, b) positioning the frame of the carrier in the first position such that when the carrier is held by a person, the carrier supports the ladder; and c) wearing a harness of the carrier to support the ladder off of the ground.

In yet another aspect of the invention, a method for support while sitting comprises: a) coupling a first member of a frame of a carrier with a ladder, wherein the frame is coupleable in a first position and in a second position; and b) positioning the frame of the carrier in the second position such that when a person sits on the second member of the carrier's frame, the frame and the ladder, together, support the person.

BRIEF DESCRIPTION OF THE DRAWINGS

Each of FIGS. 1A and 1B shows a perspective view of a carrier coupled with a ladder, each according to an embodiment of the invention.

Each of FIGS. 2A and 2B shows a perspective view of the carrier shown FIGS. 1A and 1B, each according to an embodiment of the invention.

DETAILED DESCRIPTION

Figure 1A:
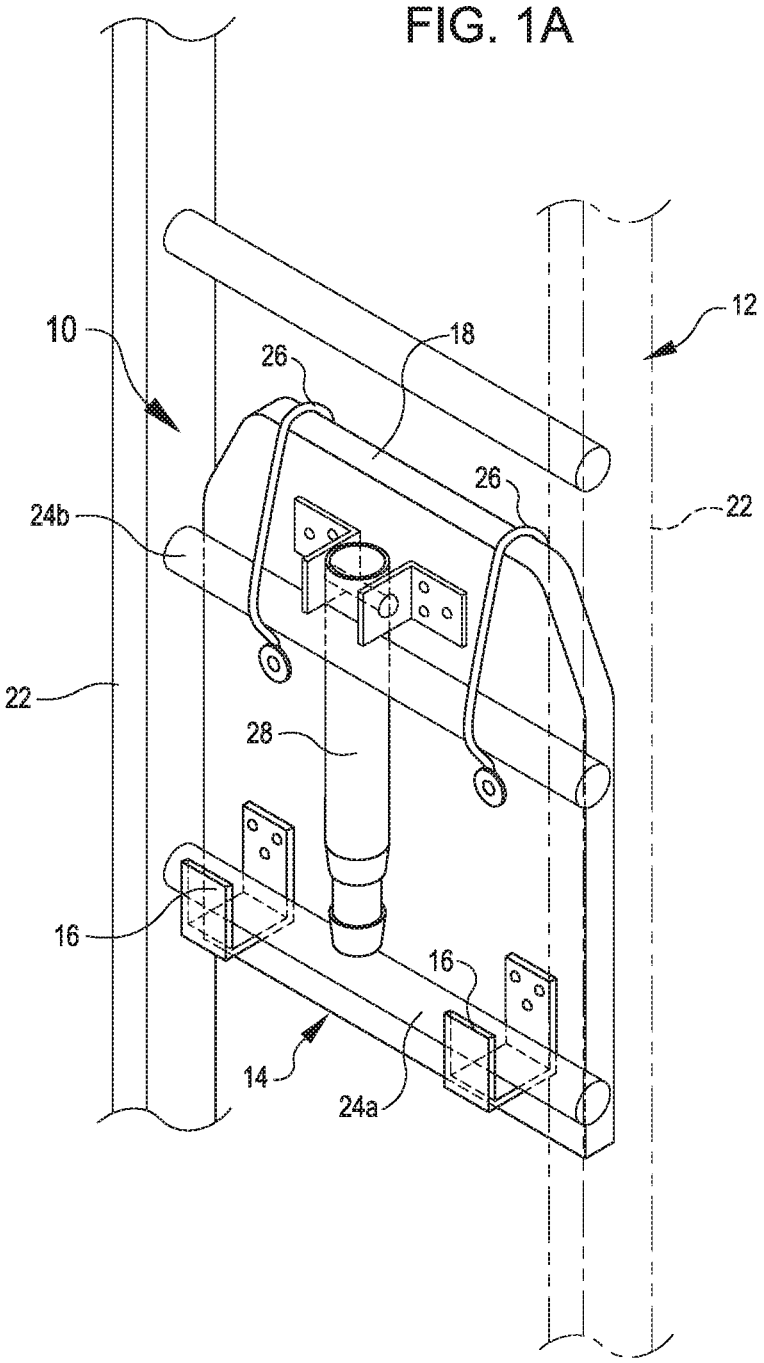
FIG. 1A shows the carrier coupled in a first position.
Figure 1B:
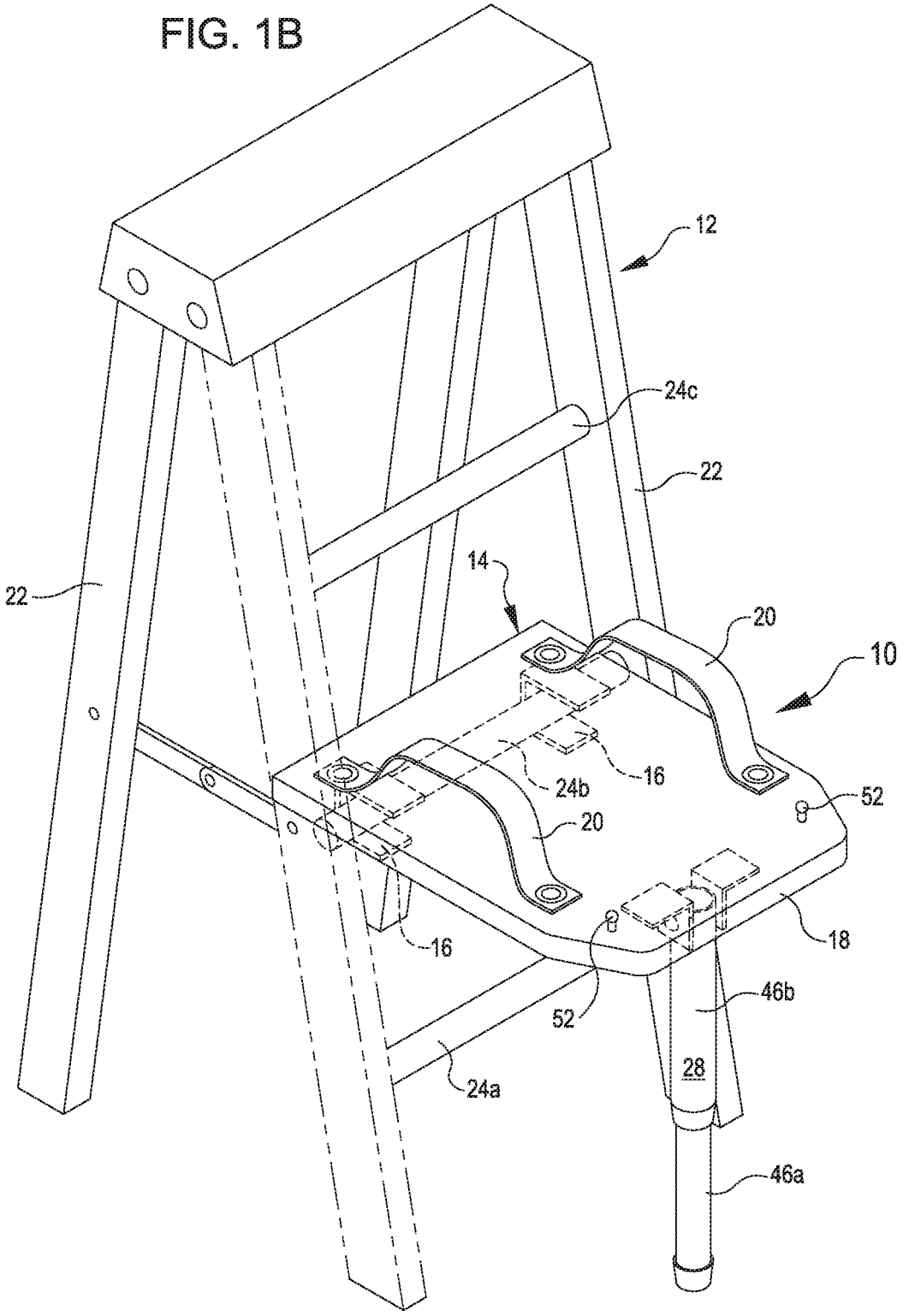
FIG. 1B shows the carrier coupled in a second position.

Each of FIGS. 1A and 1B shows a perspective view of a carrier 10 coupled with a ladder 12, each according to an embodiment of the invention. FIG. 1A shows the carrier 10 coupled in a first position, and FIG. 1B shows the carrier 10 coupled in a second position. Although the ladder 12 shown here is a step ladder that is five feet tall, the ladder 12 may be any other type of ladder, such as a step ladder that is taller or shorter than five feet, an extension ladder, or a multipurpose ladder. The carrier 10 includes a frame 14 (discussed in greater detail in conjunction with the FIGS. 2A-3) that may be coupled to the ladder 12 in the first and second positions. The frame 14 includes a first member 16 and a second member 18. In the first position, the frame's first member 16 holds the ladder 12 such that the carrier 10 may be used by one to carry the ladder 12 to where one will be working. In the second position, the frame's second member 18 may be used as a seat that one can sit on during a break or lunch. The carrier 10 also includes a harness 20 (discussed in greater detail in conjunction with FIG. 2B) that one can wear to hold the frame 14 to himself/herself.

With the ability to position the carrier's frame 14 in a first position and a second position, one can use the carrier 10 to carry a ladder 12 to and from where one will be working without having to use one or both of one's hands. This allows one to use both hands and/or arms to carry one's tools and/or supplies to where one will be working. Then, later in the day, one can use the same carrier 10 to sit on while taking a break.

In the first position, the carrier 10 may lie in any desired orientation relative to the ladder 12 that allows one to carry the ladder 12. For example, in this and other embodiments the carrier 10 lies substantially parallel to the rails 22 of the ladder 12. More specifically, the frame's second member 18 lies adjacent and parallel to the ladder's rails 22. In addition, two rungs 24*a* and 24*b* of the ladder 12 contact the carrier 10. The frame's first member 16 holds the rung (or step) 24*a* while the frame's second member 18 contacts the second rung 24*b*. The carrier 10 also includes a strap 26 (discussed in greater detail in conjunction with FIG. 2A) that holds the ladder 12 against the carrier's second member 18 when the carrier 10 is in the first position. More specifically, the carrier 10 includes two straps 26. By holding two of the ladder's rungs 24*a* and 24*b*, the carrier 10 can more securely hold the ladder 10 while one carries the ladder 12 on one's back.

Other embodiments are possible. For example, when the carrier 10 is in the first position, the carrier's second member 18 may not contact the ladder 10, while the carrier's first member 16 holds the ladder 10. For another example, the carrier 10 may lie in an orientation relative to the ladder 12 in which the carrier's second member 18 forms an angle with each of the ladder's rails 22 that is not zero degrees.

In the second position, the carrier 10 may also lie in any desired orientation relative to the ladder 12 that allows one to use the carrier 10 to support oneself while resting or eating lunch. For example, in this and other embodiments the carrier 10 lies at an angle between 90 and 45 degrees relative to each of the rails 22 of the ladder 12. More specifically, the carrier's second member 18 lies at an angle that is substantially 75 degrees relative to each of the ladder's rails 22. In this configuration, the carrier's second member 18 will lie substantially parallel to the ground that the ladder 12 is standing on. The carrier 10 also includes a leg 28 (discussed in greater detail in conjunction with FIG. 2A) to help the ladder 10 support the carrier's second member 18 in the second position.

Other embodiments are possible. For example, when the carrier 10 is in the second position, the carrier's second member 18 may lie at an angle relative to each of the ladder's rails 22 that positions the second member 18 such that the member 18 extends from the rails 22 in a direction away from the ground or in a direction toward the ground. For another example, the carrier 10 may include a second strap that may be attached to a rung 24*c* and/or 24*d* of the ladder 10 that is above the rung 24*b* to help support the carrier's second member 18 in the second position. In such configurations the carrier 10 may or may not include the leg 28.

Figure 2A:
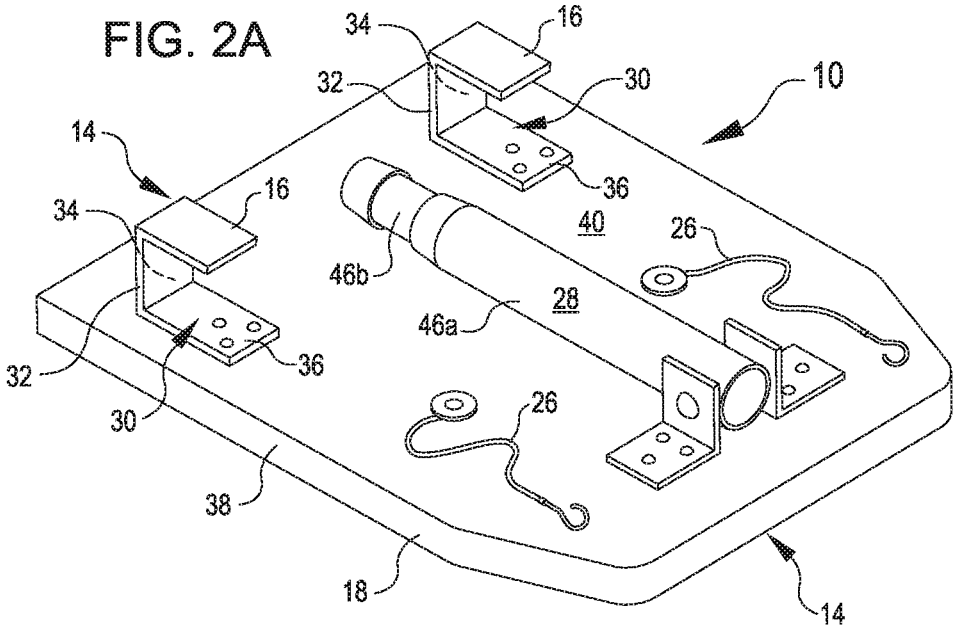
FIG. 2A shows a side of the carrier that is coupled with a ladder.
Figure 2B:
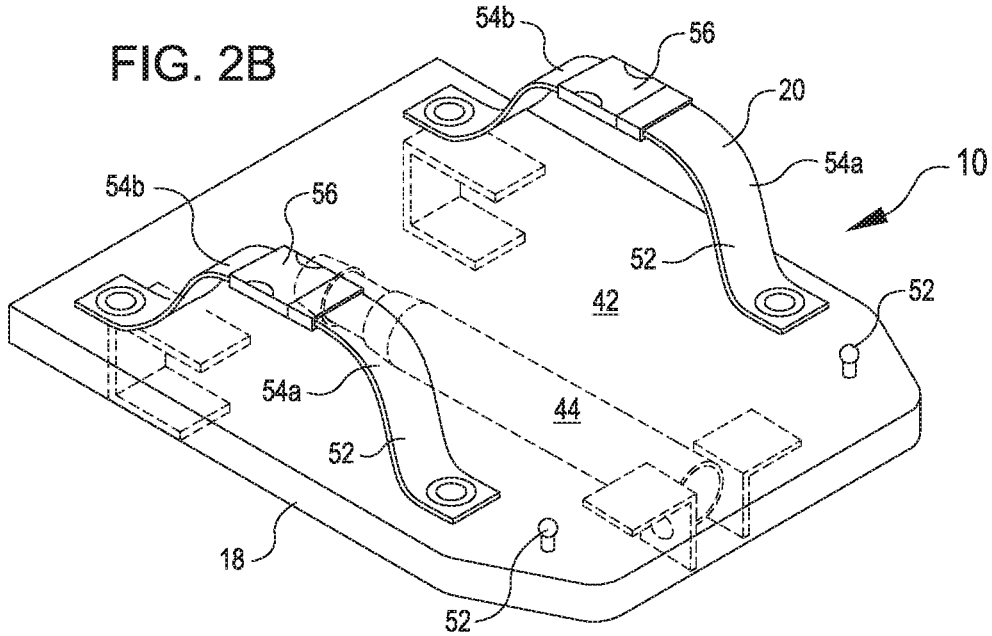
FIG. 2B shows a side of the carrier that is coupled with a person.
Figure 3:
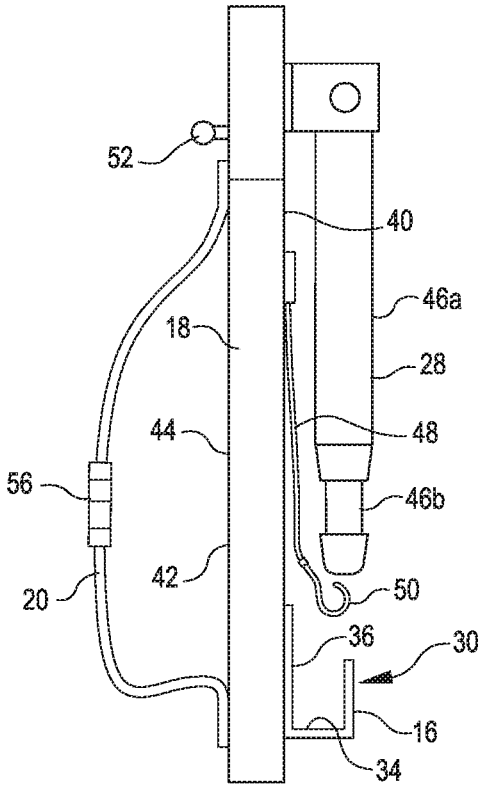
FIG. 3 shows a side view of the carrier shown in FIGS. 1A-2B, according to an embodiment of the invention.

Each of FIGS. 2A and 2B shows a perspective view of the carrier 10 shown in FIGS. 1A and 1B, each according to an embodiment of the invention. FIG. 2A shows a side of the carrier 10 that may be coupled with a ladder 12 (FIGS. 1A and 1B). FIG. 2B shows a side of the carrier 10 that may be coupled with a person. And, FIG. 3 shows a side view of the carrier 10 shown in FIGS. 1A-2B, according to an embodiment of the invention.

As previously mentioned, the carrier 10 includes a frame 14 that has a first frame member 16 coupleable with a ladder 12 to hold the ladder 12 in a first position, and a second frame member 18 to support a person sitting on the carrier 10 while the carrier 10 is in the second position. The first frame member 16 may be configured as desired to hold the ladder 12 while the carrier 10 is in the first position. For example, in this and other embodiments the first member 16 includes a hook 30 having a bend 32 to receive one of the rungs 24*a*-24*d*. The hook 30 and bend 32 are configured to loosely receive the rung 24*a*, 24*b*, 24*c*, or 24*d* to allow one to easily uncouple the first frame member 16 from the ladder 10 when desired, and thus allow the carrier 10 to be releasably coupled with the ladder 10. More specifically, the first frame member 16 includes two hooks 30 each having a bend 32. When the carrier 10 is coupled to the ladder 12 and in the first position, one of the rungs 24*a*-24*d* lies in each of the bends 32 and is surrounded by each of the hooks 30. When the carrier 10 is used to carry the ladder 12, the rung 24*a*, 24*b*, 24*c*, or 24*d* that lies in the bends 32 contacts each of the walls 34 and is suspended above the ground by its contact with the walls 34. When the carrier 10 is coupled to the ladder 12 and in the second position, one of the rungs 24*a*-24*d* lies in each of the bends 32 and is surrounded by each of the hooks 30. When one is sitting on the carrier 10 in this second position, the rung 24*a*, 24*b*, 24*c*, or 24*d* that lies in the bends 32 contacts each of the walls 36 and is supported above the ground by its contact with the walls 36.

Other embodiments are possible. For example, the first frame member 16 may include a rope or other flexible structure in lieu of the hooks 30.

The first frame member 16 may be coupled with the second frame member 18 as desired to provide the strength required to support the ladder 12 above the ground when the carrier 10 is used to carry the ladder 12 to a location. For example, in this and other embodiments the first frame member 16 is coupled to the second frame member 18 with a conventional screw. In other embodiments, the first frame member 16 may be releasably coupled to the second frame member 18 to allow one to change the location of the first frame member 16 on the second frame member 18 in response to coupling the carrier 10 to another ladder 12 that is not configured the same as the ladder 12 shown in FIGS. 1A and 1B. In still other embodiments, the first frame member 16 may be coupled to the second frame member 18 such that the location of first frame member 16 on the second frame member 18 may be changed without separating the first frame member 16 from the second frame member 18.

The second frame member 18 may be configured as desired to support one sitting on the carrier 10 while the carrier 10 is in the second position. For example, in this and other embodiments the second frame member 18 includes a flat body 38 having a first side 40 (FIG. 2A), a second side 42 (FIG. 2B), and sized to provide enough area for one to sit on. The first side 40 is the side to which the first frame members 16 are coupled, and the second side 42 includes a region 44 that one sits on when the carrier 10 is in the second position. The region 44 is flat and may include a layer of soft material, such as foam, to soften the contact made by one's buttocks while sitting on the region 44 and one's back while carrying the ladder 12 with the carrier 10. In other embodiments, the region 44 may be contoured to provide more comfort while one sits on the region 44, or while one carries the ladder 12.

Other embodiments are possible. For example, the second frame member 18 may be sized to provide enough area for more than one person to sit on. In such an embodiment, the second frame member 18 may releasably coupleable to two ladders 12 in the second position to form a bench between the two ladders 12. Such an embodiment could allow one to even more securely couple a ladder 12 to the carrier 10 in a first position. For another example, the second frame member 18 may be configured to modify its size and/or shape to accommodate different sized persons and/or different sized ladders 12.

In this and other embodiments, the carrier 10 also includes a leg 28, which may be configured as desired to provide additional support. For example, in this and other embodiments the leg 28 includes two sections 46*a* and 46*b*. To allow one to adjust the length of the leg 28 and thus allow one to couple the carrier 10 to different rungs 24*a*, 24*b* and 24*c* of the ladder 12, as desired, the section 46*b* nests with the section 46*a* and can telescope outward relative to the section 46*a*. To facilitate positioning the carrier 10 in a first position relative to a ladder 12, the leg 28 is pivotally coupled to the second frame member 18.

Other embodiments are possible. For example, the carrier 10 may include more than one leg 28. For another example, the leg 28 may be releasably coupled with the second frame member 18 and carried separately from the second frame member 18 to where one will be working or using the ladder 12.

Still referring to FIGS. 1A and 3, the carrier 10 may also include a strap 26, which may be configured as desired to help hold the ladder 12 against the carrier's second member 18 when the carrier 10 is in the first position. For example, in this and other embodiments the carrier 10 includes two straps 26, each having an elastic body 48 and a hook 50. When stretched over a part of the ladder 12, such as a rung 24*b*, 24*c*, and/or 24*d*, the elastic body 48 generates tension and urges the rung 24*b*, 24*c*, and/or 24*d* against the second frame member 18. To keep the elastic body 48 in tension, the hook 50 engages a respective one of the two posts 52 (FIGS. 2B and 3).

Other embodiments are possible. For example, the strap 26 may be a rope. For another example, the carrier 10 may include a third frame member that is similar to the first frame member 16 but pivotable relative to the second frame member 18 to hold a component of the ladder 12 against the second frame member 18 when closed, and release the ladder's component when opened.

Referring to FIGS. 2B and 3, the harness 20 may be configured as desired to allow one to hold the carrier 10 without using either of one's hands. For example, in this and other embodiments the harness 20 includes two shoulder straps 52 each mounted to the second side 42 of second frame member 18 so that each wraps over a respective one of a person's shoulders. To allow one to adjust the length of each shoulder strap 52 to accommodate different sized persons, each shoulder strap 52 includes a first portion 54*a*, a second portion 54*b*, and a buckle 56 that couples the two portions 54*a* and 54*b* together.

Each of the first portions 54*a* may be coupled with the second frame member 18 as desired to provide the strength required to support the ladder 12 above the ground when the carrier 10 is used to carry the ladder 12 to a location. For example, in this and other embodiments each of the first portions 54*a* is coupled to the second frame member 18 with a conventional screw. In other embodiments, each of the first portions 54*a* may be releasably coupled to the second frame member 18 to allow one to change the location of one or both of the first portions 54*a* on the second frame member 18 in response to coupling the carrier 10 to a different person. In still other embodiments, each of the first portions 54*a* may be coupled to the second frame member 18 such that the location of each of the first portions 54*a* on the second frame member 18 may be changed without separating the first portion 54*a* from the second frame member 18.

Other embodiments are possible. For example, the harness 20 may include a belt sized and configured to wrap around one's waist when one uses the carrier 10 to carry a ladder 12 to a location.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A carrier comprising:

a frame coupleable with a ladder in:

a first position in which the frame supports the ladder when a person carries the frame, and a second position in which the frame and ladder, together, support a person when the person sits on the frame, the frame including:

a first member that holds the ladder when the frame is in the first position, and a second member that, when the frame is in the second position, supports a person sitting on the frame and extends out beyond a footprint of the ladder;

a leg coupled with the frame's second member and configured to help support the second member by extending from the frame's second member out beyond the footprint of the ladder in a longitudinal direction and to the ground, when the frame is coupled with the ladder in the second position and while a person sits on the second member; and a harness operable to hold the frame to a person.

2. The carrier of claim 1 wherein when the carrier is coupled to a ladder and in the first position, the frame's first member holds a rung of the ladder and the frame's second member lies adjacent and parallel a side rail of the ladder.

3. The carrier of claim 1 wherein when the carrier is coupled to a ladder and in the first position, the frame's second member contacts a rung of the ladder that is adjacent the ladder's rung that the frame's first member holds.

4. The carrier of claim 1 wherein when the carrier is coupled to a ladder and in the second position, the frame's first member holds a rung of the ladder and the frame's second member lies at angle relative to a side rail that is less than 90° yet greater than 45°.

5. The carrier of claim 1 wherein the frame is releasably coupleable with the ladder.

6. The carrier of claim 1 wherein the frame's first member includes a hook having a bend in which a rung of a ladder is disposed when the frame is coupled to the ladder in the first position and in the second position.

7. The carrier of claim 1 wherein the frame's first member includes two hooks each having a bend in each of which a rung of a ladder is disposed when the frame is coupled to the ladder in the first position and in the second position.

8. The carrier of claim 7 wherein each of the hooks holds the same, single rung of a ladder.

9. The carrier of claim 1 wherein the frame's second member includes a region that is flat and configured to support a person while the person sits on the frame.

10. The carrier of claim 1 wherein the harness is adjustable to accommodate different sized people.

11. The carrier of claim 1 wherein the harness includes two shoulder straps, each configured to contact a respective one of a person's shoulders, when a person carries the frame.

12. The carrier of claim 1 wherein the leg has a length that is adjustable.

13. The carrier of claim 1 further comprising a strap configured to hold the ladder when the frame is coupled to the ladder and in the first position.

14. The carrier of claim 13 wherein the strap is configured to hold a portion of the ladder that is not held by the frame's first member.

* * * * *